US006215481B1

(12) United States Patent
Tanijiri et al.

(10) Patent No.: US 6,215,481 B1
(45) Date of Patent: Apr. 10, 2001

(54) DISPLAY APPARATUS

(75) Inventors: Yasushi Tanijiri, Osakasayama; Kenji Ishibashi, Izumi; Hideki Nagata, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/154,032

(22) Filed: Sep. 16, 1998

(30) Foreign Application Priority Data

Sep. 18, 1997 (JP) ..... 9-253169
Jan. 27, 1998 (JP) ..... 10-013700

(51) Int. Cl.[7] ..... G09G 5/00
(52) U.S. Cl. ..... 345/207; 345/205; 345/206; 359/630; 359/631
(58) Field of Search ..... 345/109, 205, 345/207, 206; 359/630, 631, 196

(56) References Cited

U.S. PATENT DOCUMENTS 5,115,228 * 5/1992 Harris et al. ..... 340/716
5,418,546 * 5/1995 Nakagakiuchi et al. ..... 345/85
5,467,104 * 11/1995 Furness, III et al. ..... 345/8
5,592,189 * 1/1997 Kuzunuki et al. ..... 345/87
5,596,339 * 1/1997 Furness, III et al. ..... 345/8
5,671,076 * 9/1997 Matsubara et al. ..... 359/196
5,712,649 * 1/1998 Tosaki ..... 359/630
5,742,264 * 4/1998 Inagaki et al. ..... 359/630
5,880,888 * 3/1999 Schoenmakers et al. ..... 359/631

FOREIGN PATENT DOCUMENTS

H4-100088 4/1992 (JP) .
H7-135623 5/1995 (JP) .

* cited by examiner

*Primary Examiner*—Richard Hjerpe
*Assistant Examiner*—Kimnhung Nguyen
(74) *Attorney, Agent, or Firm*—Burns, Doane, Swecker & Mathis, LLP

(57) ABSTRACT

A display apparatus of the present invention includes scanning mirrors for scanning light emitted from a light source, a position sensor diode for detecting whether scanning by the scanning mirrors is normal or abnormal, a light intercepting shutter for intercepting light when the position sensor diode detects that the scanning is abnormal.

28 Claims, 10 Drawing Sheets

DISPLAY APPARATUS

This application is based on applications Nos. H9-253169 and H10-013700 filed in Japan, the contents of which are hereby incorporated by reference.

BACKGROUND OF THE INVENTION

1. Field of the Invention

The present invention relates to a display apparatus for providing pictures by scanning light emitted from a light source.

2. Description of the Prior Art

As displays, flat-panel picture display apparatuses such as liquid crystal displays and CRT displays are generally known. As a display apparatus capable of inexpensively providing high-definition pictures, a scanning picture display apparatus has been disclosed.

The scanning picture display apparatus is designed to display pictures to the viewer's eye by scanning light emitted from a light source. For example, Japanese Laid-open Patent Applications Nos. H4-100088 and H7-135623 disclose picture display apparatuses of this type. These apparatuses provide two-dimensional pictures by scanning in the horizontal and vertical directions light emitted from a point light source.

In order for a scanning picture display apparatus to provide stable pictures, it is a condition to perform stable light scanning. Vibration of a mirror is typically used as light scanning means. These apparatuses include means for controlling the amplitude and the speed of the vibration mirror so that stable light scanning is performed. In the conventional apparatuses, means for detecting the movement of the vibration mirror is provided and based on the result of the detection, the controlling means controls the vibration mirror.

FIG. 1 schematically shows the structure of an example of a scanning mirror having the detecting means. Reference numeral 32 represents the scanning mirror and reference numerals 31 and 33 represent the detecting means. Of these detecting means, the detecting means 31 is a light intercepting plate and the detecting means 33 is a photointerruptor. The scanning mirror 32 is held by a mirror holder 34 and vibrates by being driven by driving portion 35. The light intercepting plate 31 operates in conjunction with the vibration of the scanning mirror 32.

By the light intercepting plate 31 moving, a space 33*a* serving as the optical path of photoelectrons of the photointerruptor 33 is intercepted or not intercepted. Therefore, by detecting the voltage, the movement of the light intercepting plate 31 is determined, so that the movement of the scanning mirror 32 is detected. Based on the result of the detection, the controlling means controls driving portion 35 for driving the scanning mirror 32.

In the scanning picture display apparatus, since pictures are provided to the viewer's eye by scanning light from a point light source, light having a higher intensity than the light provided by a flat-panel picture display apparatus is required to provide sufficiently bright pictures. However, when high-intensity light is emitted from a point light source, if scanning is stopped because of a failure in scanning means, high-intensity light will concentrate on one point on the viewer's eye, which can cause troubles to the viewer's eye. Therefore, in the conventional apparatus, it is impossible to emit light having sufficiently high intensity for making the provided pictures sufficiently bright for the viewer.

In order to detect the movement of the vibration mirror, the detecting means is provided on the vibration mirror. In this arrangement, the detecting means can impair the vibration of the mirror. In order to provide high-definition scanning pictures, it is necessary for the vibration frequency of the mirror to be high. However, the weight of the detecting means provided on the mirror limits the frequency.

SUMMARY OF THE INVENTION

An object of the present invention is to provide a display apparatus for displaying stable high-definition pictures that are safe for the eye.

To achieve the above-mentioned object, a display apparatus of the present invention comprises: scanning means for scanning light emitted from a light source; detecting means for detecting whether scanning by the scanning means is normal or abnormal; and light intercepting means for intercepting light when the detecting means detects that the scanning is abnormal.

According to this structure, the light intercepting means intercepts the light when the scanning means malfunctions or breaks. As a result, it never occurs that light is continuously supplied onto one point on the viewer's eye.

Moreover, a display apparatus of the present invention comprises: a light source for emitting light modulated based on a video signal; scanning means for scanning the emitted light; light intercepting means for intercepting the emitted light; detecting means for detecting whether scanning by the scanning means is normal or abnormal; and controlling means for stopping light emission from the light source when the detecting means detects that the scanning is abnormal.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

<First Embodiment>

Figure 1:
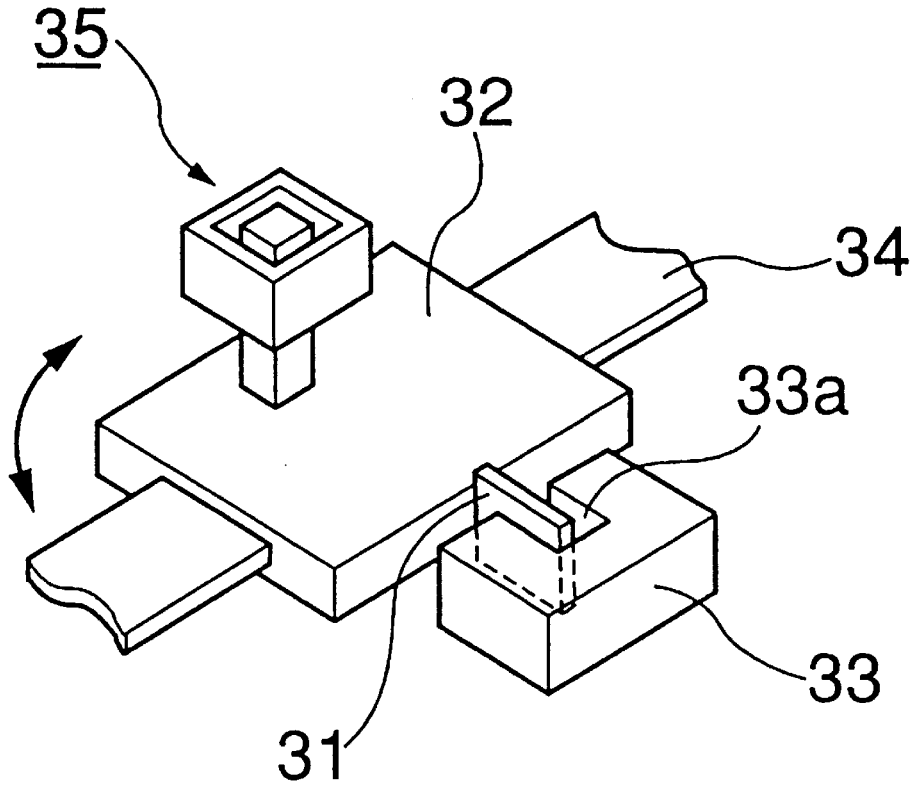
FIG.1 PRIOR ART
FIG. 1 schematically shows the structure of a prior art scanning mirror.
Figure 2:
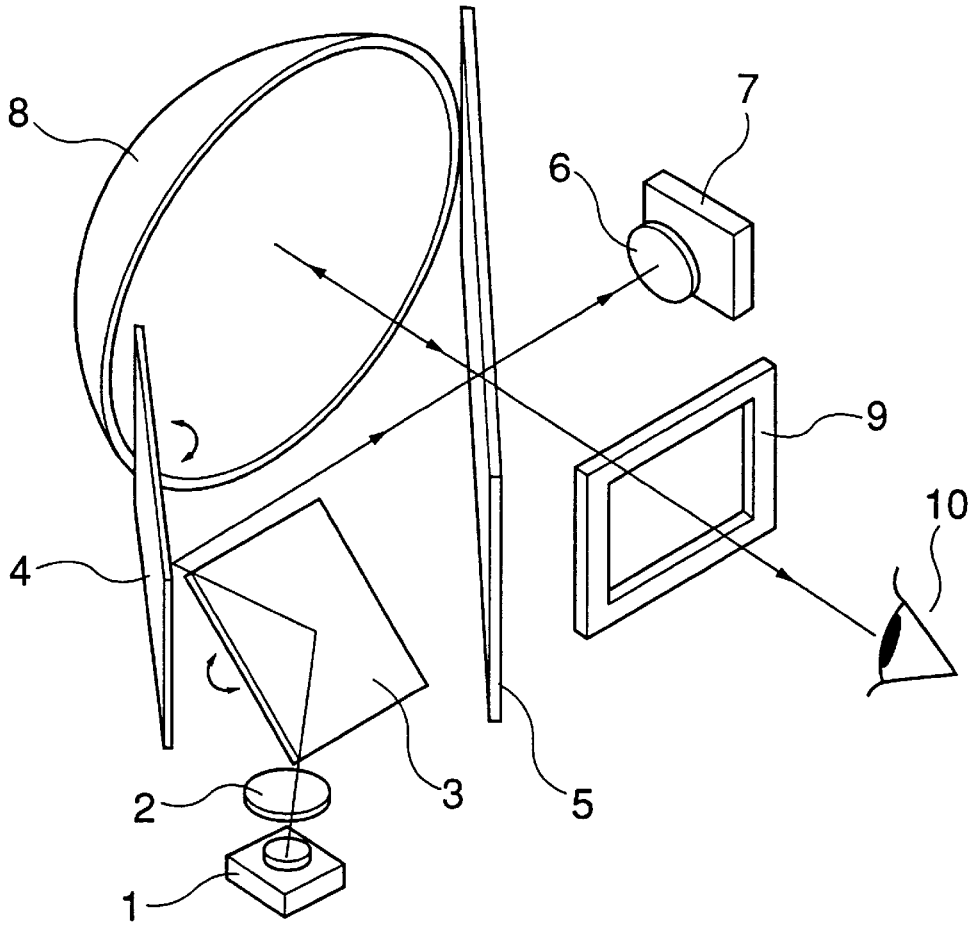
FIG. 2 schematically shows the structure of a display apparatus of the present invention.

FIG. 2 schematically shows the structure of a display apparatus of this embodiment. Reference numeral 1 represents a laser light source (point light source) for emitting light modulated based on a video signal. Reference numeral 2 represents a lens for directing the light from the light source (light source light) to subsequently-described scanning means. Reference numerals 3 and 4 represent a vertical vibration mirror and a horizontal vibration mirror for scanning the light source light in two-dimensional directions. The vertical vibration mirror 3 and the horizontal vibration mirror 4 constitute the scanning means.

Reference numeral 5 represents a half mirror (optical path splitting means) for transmitting light from the scanning means 3 and 4 so as to be directed to a subsequently-described position sensor diode, and reflecting the light so as to be directed to a subsequently-described concave mirror. Reference numeral 8 represents the concave mirror (eyepiece optical system) for projecting the light from the half mirror 5 onto a viewer's eve 10. By the light projection, the viewer views a two-dimensional picture formed of two-dimensionally scanned light source light. The scanning mirror 4 is disposed in positions substantially conjugate with the viewer's eye with respect to the concave mirror 8.

Reference numeral 9 represents a light intercepting shutter for intercepting light, for example, when the scanning mirrors 3 and 4 break to stop scanning. In this embodiment the light intercepting shutter 9 comprises an LCD shutter. Reference numeral 6 represents a condenser lens for condensing light to the position sensor diode. Reference numeral 7 represents the position sensor diode (PSD) serving as scanning direction detecting means for detecting the scanning direction of the light source light. The result of the detection by the PSD 7 is outputted to non-illustrated scanning direction controlling means and light interception controlling means.

The scanning direction controlling means controls the scanning mirrors 3 and 4 based on the detection result transmitted from the PSD 7. The light interception controlling means determines whether scanning by the scanning mirrors 3 and 4 is performed normally or not based on the detection result transmitted from the PSD 7. When it is determined that scanning is not performed normally, the light interception controlling means causes the light intercepting shutter 9 to intercept light.

While the PSD 7 is used as the scanning direction detecting means in the apparatus of this embodiment, the present invention is not limited thereto. Any element that detects light such as a phototransistor or a photodiode may be used.

While light in the picture area is used as the detection light, for example, an arrangement may be employed in which an infrared light source is provided in addition to the light source 1 for pictures and the detecting means uses the infrared light as the detection light. Moreover, an arrangement may be employed in which the point light source 1 emits light outside the picture area and the detecting means performs the detection with the light as the detection light. In this arrangement, it is preferable for the detection light to be intercepted by the frame of a picture light window and the periphery thereof so that the detection light is not incident on the viewer's eye.

Figure 3:
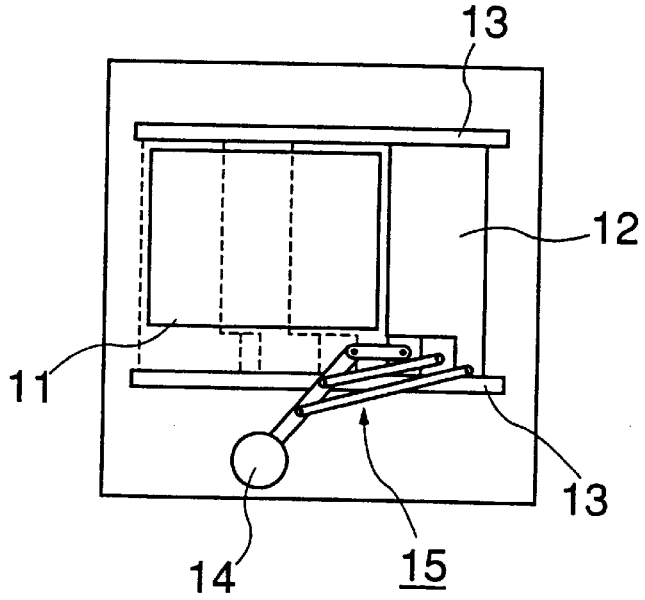
FIG. 3 schematically shows the structure of an example of light intercepting means of the present invention.
Figure 4:
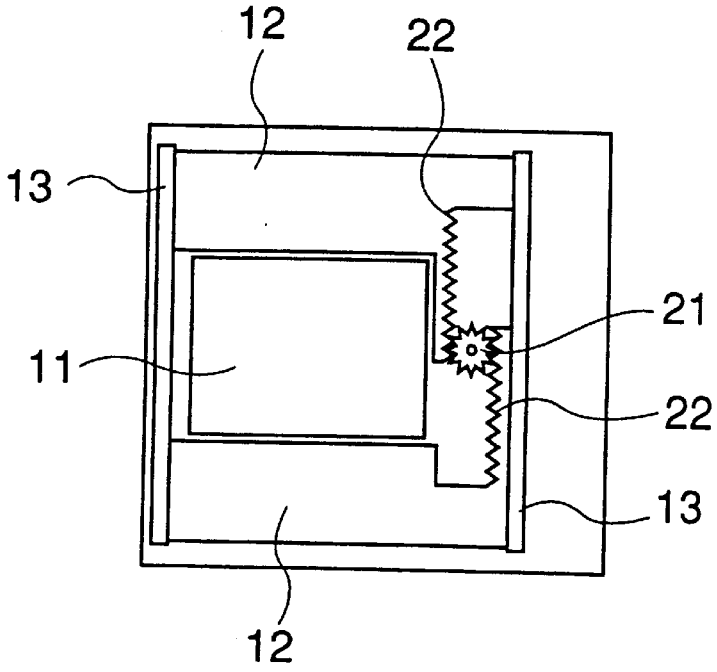
FIG. 4 schematically shows the structure of another example of the light intercepting means of the present invention.

While the light intercepting means comprises the LCD shutter in this apparatus, it is not limited to the light intercepting shutter as long as switching between light interception and transmission can be performed. For example, a mechanical shutter as shown in FIG. 3 or 4 may be used. Moreover means for controlling light emission from the light source 1 may be used. In this case, when it is determined that scanning is not performed normally, the means stops light emission from the light source 1.

The structure of the mechanical shutter shown in FIG. 3 will be described. Reference numeral 11 represents a picture light window. Reference numeral 12 represents a light intercepting shutter comprising three light intercepting plates. When the light intercepting shutter 12 is in a state shown by the solid line in the figure, the picture light window 11 is opened to transmit light. When the light intercepting shutter 12 is in a state shown by the dotted line, the picture light window 11 is closed to intercept light. Reference numeral 13 is a guide member for guiding the light intercepting shutter 12 so as to be movable in the horizontal direction.

Reference numeral 14 represents a motor for providing a rotating force for sliding the light intercepting shutter 12 in the horizontal direction. Reference numeral 15 represents a link mechanism. The rotating force of the motor 14 is transmitted by way of the link mechanism 15 to the light intercepting plates of the light intercepting shutter 12. Switching between the light transmitting condition and the light intercepting condition is made by moving the light intercepting shutter 12 in the horizontal direction.

The structure of the mechanical shutter shown in FIG. 4 will be described. Reference numeral 11 represents a picture light window. Reference numeral 12 represents a light intercepting shutter comprising two light intercepting plates placed one above the other. When the light intercepting shutter 12 is in the state shown in the figure, the picture light window 11 is opened to intercept light. Reference numeral 21 represents a gear. Reference numeral 22 represents a rack provided on each light intercepting plate. Reference numeral 13 represents a guide member. The guide member 13 guides the light intercepting shutter 12 so as to be movable in the vertical direction. The gear 21 transmits a rotating force of a non-illustrated motor to the rack 22. Consequently, the rotating force of the motor vertically moves the light intercepting shutter 12, thereby switching between the light intercepting condition in which the window 11 is completely closed and the light transmitting condition in which the window 11 is opened.

Figure 5:
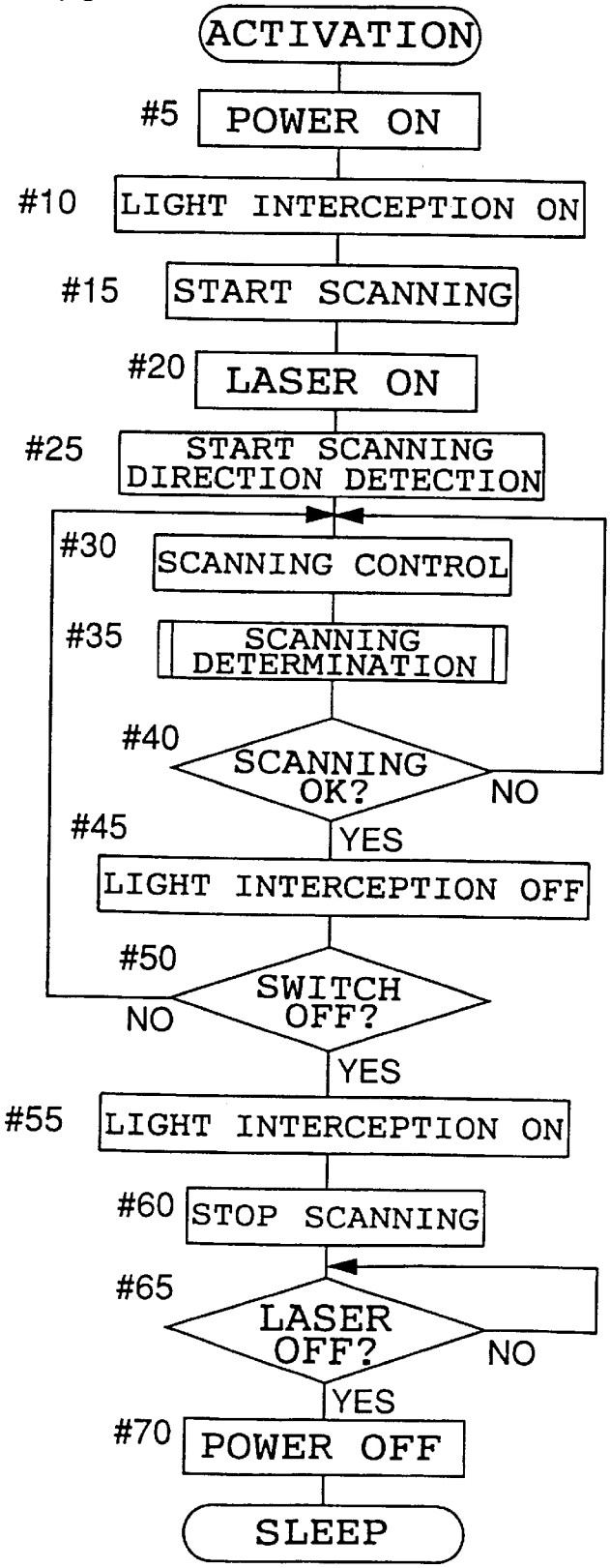
FIG. 5 is a flowchart showing a control method of controlling means of a first embodiment.

FIG. 5 is a flowchart showing a control method of this apparatus. Based on the viewer's operation, power is turned on at step #5. Then, at step #10, the light intercepting shutter 9 is brought into the light intercepting condition (light interception ON). Then, at step #15, scanning by the scanning mirrors 3 and 4 is started. Then, at step #20, the light source 1 is turned on, and at step #25, the PSD 7 starts light detection (detection of the scanning direction).

Figure 6:
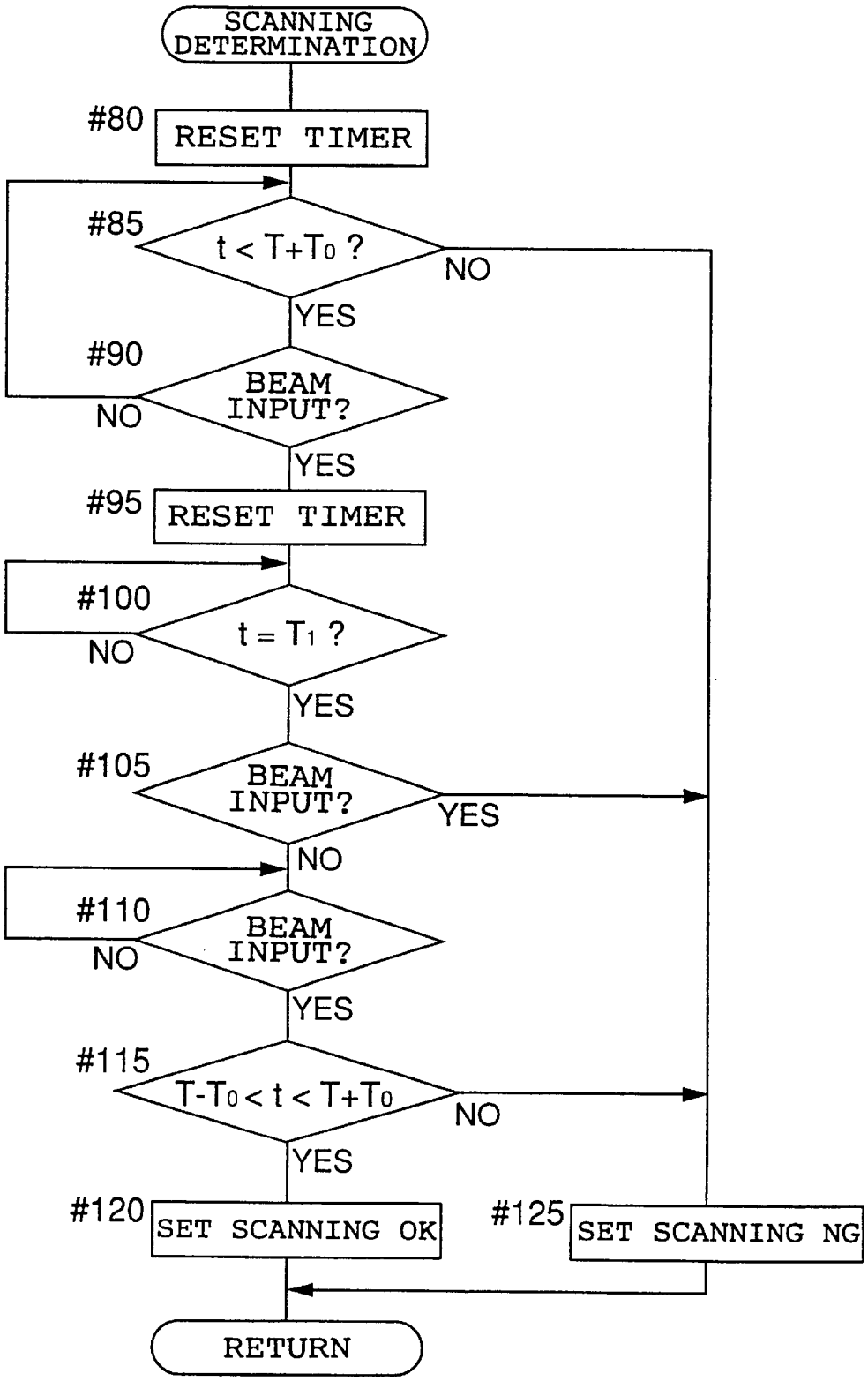
FIG. 6 is a subroutine showing a control method of a first example of scanning determination.
Figure 7:
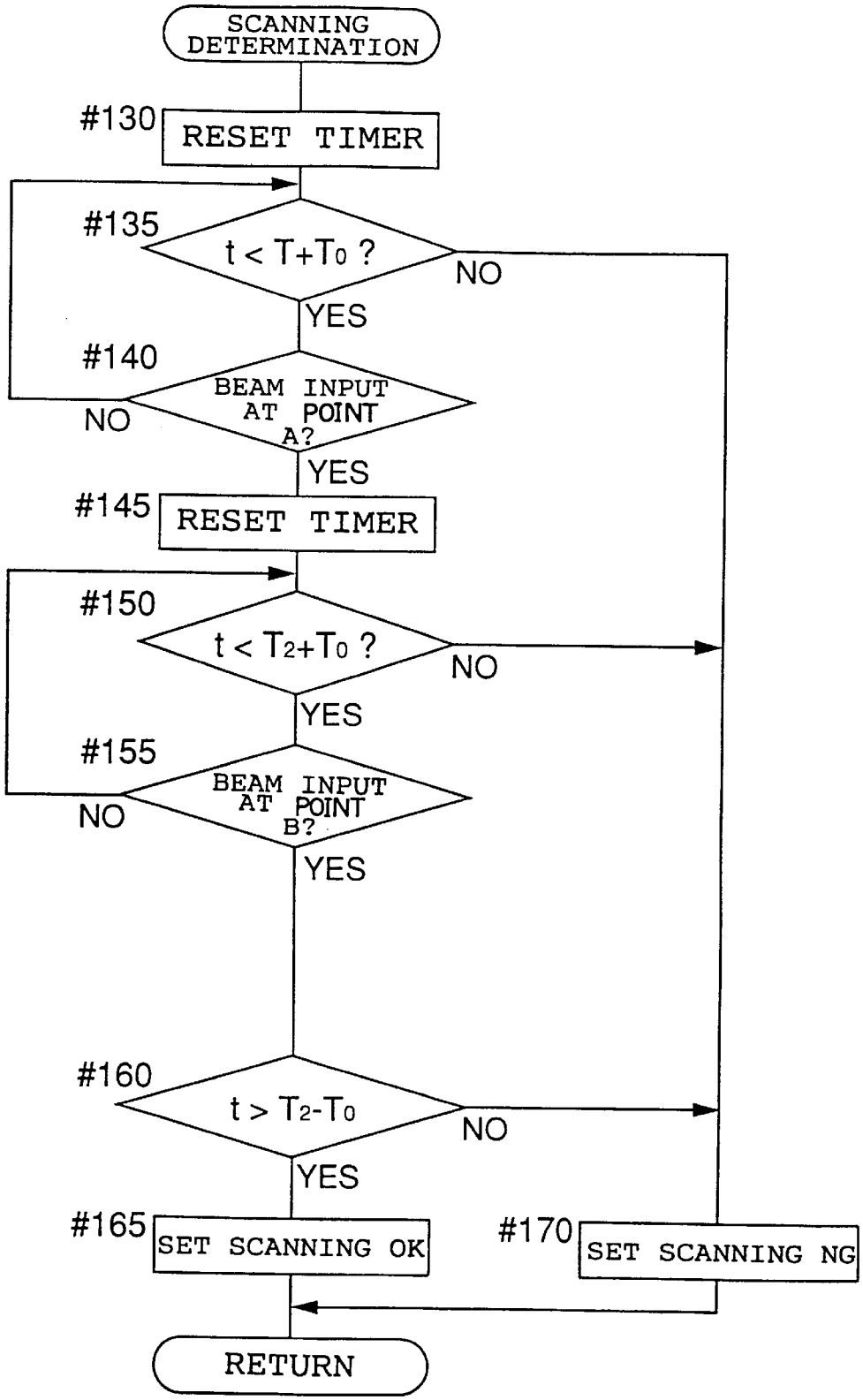
FIG. 7 is a subroutine showing a control method of a second example of scanning determination.
Figure 8:
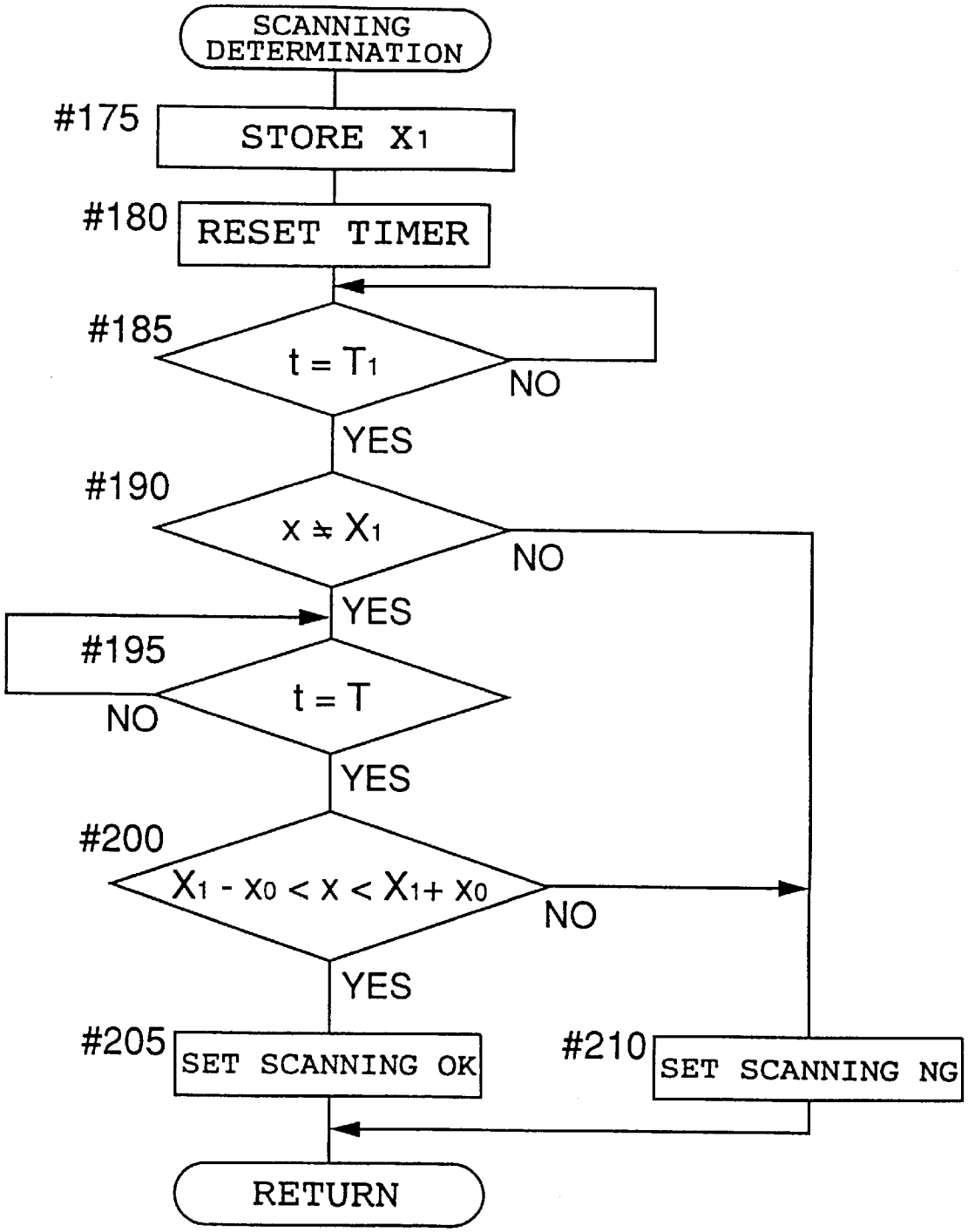
FIG. 8 is a subroutine showing a control method of a third example of scanning determination.

At step #30, the scanning direction controlling means controls the scanning by the scanning mirrors 3 and 4 based on the result of the scanning direction detection. At step #35, the light interception controlling means performs scanning determination. The subroutine of the scanning determination is shown in FIGS. 6 to 8 (first to third examples). When it is determined that scanning is OK in the scanning determination, the process proceeds from step #40 to step #45. When it is determined that scanning is not OK, the process returns from step #40 to step #30.

At step #45, the light interception controlling means brings the light intercepting shutter 9 into the light transmitting condition (light interception OFF). The picture light is projected onto the viewer's eye under this condition. At step #50, it is determined whether a viewing end switch is operated by the viewer (switch OFF) or not. When the switch is not operated, the process returns to step #30.

When it is determined at step #50 that the switch is OFF, the light intercepting means is brought into the light intercepting condition at step #55. Then, at step #60, the scanning direction controlling means stops the scanning by the scanning mirrors 3 and 4, and at step #65, the process waits until the light source 1 is turned off. When the light source 1 is turned off, power is turned off at step #70, so that sleep state is brought about.

Now, the scanning determination subroutine performed at step #35 will be described. While first to third examples will be described as three examples of the control method of the scanning determination, the control method that can achieve the present invention is not limited thereto.

FIRST EXAMPLE

FIG. 6 shows the first example of scanning determination subroutine (step #35 of FIG. 5) by the light interception controlling means. In this subroutine, the scanning determination is performed by detecting light (beam) incident on one point on the PSD 7. Hereinafter, a phrase "beam input" will represent that light from the light source 1 is incident on one point on the PSD 7. In the subroutine, t represents the time counted by a timer, T represents the time (period) required for scanning one screen of picture when the scanning mirrors 3 and 4 operate normally, $T_0$ represents a permissible time lag, and $T_1$ represents a given time that is shorter than $T-T_0$.

First, at step #80, the timer is reset. At step #85, it is determined whether the time t counted by the timer is shorter than $T+T_0$ ($t<T+T_0$). When $t<T+T_0$, the process proceeds to step #90 to determine whether beam input occurs or not. When no beam input occurs, the process returns to step #85 to repeat steps #85 and #90 until beam input occurs. When the time t becomes equal to or longer than $T+T_0$ ($t\geqq T+T_0$) at step #85 without beam input occurring, since the scanning by the scanning mirrors 3 and 4 is too slow or the scanning mirrors 3 and 4 are stopped, the process proceeds to step #125 to set scanning NG.

When beam input occurs at step #90, the process proceeds to step #95 to reset the timer (t=0). At step #100, the process waits until the time t becomes $T_1$ ($t=T_1$). When the time t becomes $T_1$, the process proceeds to step #105 to reset the timer and determine whether beam input occurs or not. When beam input occurs, since the scanning by the scanning mirrors 3 and 4 is too fast or the scanning mirrors 3 and 4 are stopped, the process proceeds to step #125 to set scanning NG.

When it is determined at step #105 that no beam input occurs, the process proceeds to step #110 to wait until beam input occurs. When beam input occurs, it is determined at step #115 whether the time t fulfills $T-T_0<t<T+T_0$ or not. When the time t fulfills the condition, since scanning is regarded as being performed normally, the process proceeds to step #120 to set scanning OK. When the time t does not fulfill the condition, since scanning is regarded as not being performed normally, the process proceeds to step #125 to set scanning NG.

When scanning NG is set at step #125, the process proceeds to NO in the determination as to whether scanning is OK or not at step #40 of the main chart of FIG. 5. Likewise, when scanning OK is set at step #120, the process proceeds to YES in the determination at step #40.

In this scanning determination, one point on the PSD 7 is detected to perform scanning determination. However, since the point to be detected can be a black point (point where no light is incident) according to the picture, it is preferable to perform the detection of the point for a region having some area.

SECOND EXAMPLE

FIG. 7 shows the second example of scanning determination subroutine (step #35 of FIG. 5) by the light interception controlling means. In this subroutine, the scanning determination is performed by detecting light (beams) incident on two points (points A and B) on the PSD 7. In the flowchart, t represents the time counted by the timer, T represents the time (period) required for scanning one screen of picture when the scanning mirrors 3 and 4 operate normally, $T_0$ represents the permissible time lag, and $T_2$ represents the time period from the end of scanning of light supplied to the point A to the start of scanning of light supplied to the point B when the scanning mirrors 3 and 4 operate normally.

First, at step #130, the timer is reset (t=0). Then, while the time t is fulfilling $t<T+T_0$ at step #135, it is determined at step #140 whether beam input occurs at the point A or not. When beam input occurs, the process proceeds to step #145 to reset the timer again.

When the time t becomes equal to or longer than $T+T_0$ ($t\geqq T+T_0$) at step #135 without beam input occurring, since the scanning by the scanning mirrors 3 and 4 is too slow or the scanning mirrors 3 and 4 are stopped, the process proceeds to step #170 to set scanning NG. At step #145, the timer is reset and the process proceeds to step #150. While the time t is fulfilling $t<T_2+T_0$ at step #150, the process waits at step #155 until beam input occurs at the point B.

When it is determined at step #155 that beam input occurs at the point B, the process proceeds to step #160 to determine whether the time t fulfills $t>T_2-T_0$ or not. When the time t fulfills the condition, the process proceeds to step #165 to set scanning OK. When the time t does not fulfill the condition, since the scanning by the scanning mirrors 3 and 4 is too fast, scanning NG is set at step #170. When no beam input occurs after the time t becomes equal to or longer than $T_2+T_0$ ($t\geqq T_2+T_0$) at step #150, the process also proceeds to step #170 to set scanning NG. In this case, the scanning mirrors 3 and 4 are too slow or stopped.

In this scanning determination, like in the first example, when scanning NG is set at step #170, the process proceeds to NO in the determination as to whether scanning is OK or not at step #40 of the main chart of FIG. 5. Likewise, when scanning OK is set at step #165, the process proceeds to YES in the determination at step #40.

THIRD EXAMPLE

FIG. 8 shows the third example of scanning determination subroutine (step #35 of FIG. 5) by the light interception controlling means. In this subroutine, the scanning determination is performed not by detecting whether beam input occurs a point on the PSD 7 (like in the first and the second examples) but by detecting the position where beam input occurs. In the subroutine, t represents the time counted by the timer, T represents the time (period) required for scanning one screen of picture when the scanning mirrors 3 and 4 operate normally, x represents the position where beam input currently occurs, $X_1$ represents a reference position, $T_1$ represents a given time that is shorter than $T-T_0$ where $T_0$ represents the permissible time lag, and $x_0$ represents a permissible position shift corresponding to $T_0$.

First, the position where beam input currently occurs is stored as the reference position $X_1$ at step #175 and concurrently therewith, the timer is reset at step #180. When the time t becomes $T_1$ ($t=T_1$) at step #185, the process proceeds to step #190 to check that the position x where beam input currently occurs is not the reference position $X_1$. If $x=X_1$, since the scanning mirrors 3 and 4 are stopped, the process proceeds to step #210 to set scanning NG.

When $x \neq X_1$, the process proceeds to step #195 to wait until t=T. When t=T, the process proceeds to step #200 to determine whether the position x where beam input currently occurs fulfills $X_1-x_0<x<X_1+x_0$ or not. When the position x fulfills the condition, the process proceeds to step #205 to set scanning OK. When the position x does not fulfill the condition, since the scanning mirrors 3 and 4 are too slow or too fast, the process proceeds to step #210 to set scanning NG.

In this scanning determination, like in the first and the second examples, when scanning NG is set at step #210, the process proceeds to NO in the determination as to whether scanning is OK or not at step #40 of the main chart of FIG. 5. Likewise, when scanning OK is set at step #205, the process proceeds to YES in the determination at step #40.

<Second Embodiment>

Figure 9:
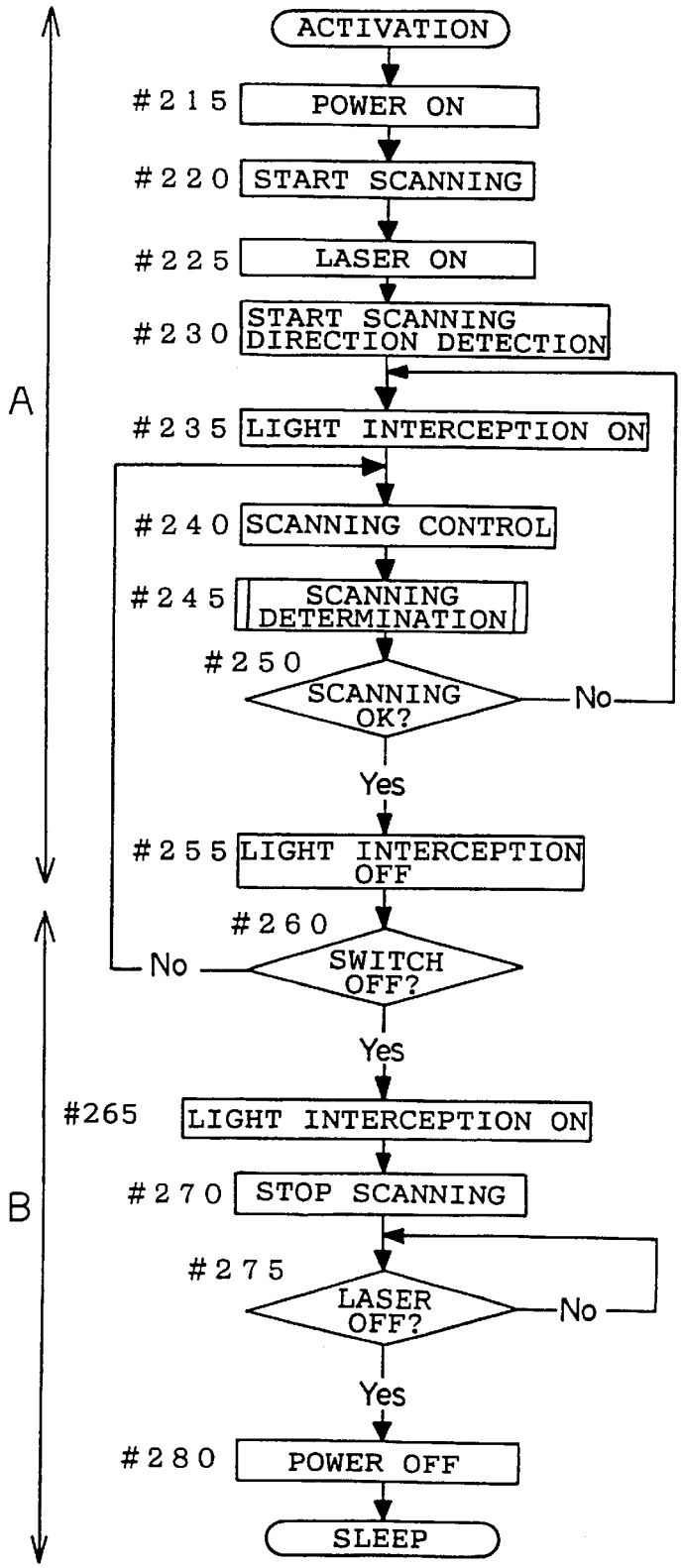
FIG. 9 is a flowchart showing a control method of controlling means of a second embodiment.

FIG. 9 is a flowchart showing a control method of this embodiment. The apparatus structure is similar to that of the first embodiment and therefore will not be described. Based on the viewer's operation, power is turned on at step #215. In this apparatus, since the light intercepting shutter 9 is always brought into the light intercepting condition when power is turned on, the light intercepting shutter 9 is in the light intercepting condition immediately after power is turned on.

Then, at step #220, scanning by the scanning mirrors 3 and 4 is started. Then, at step #225, the light source 1 is turned on, and at step #230, the PSD 7 starts light detection (detection of the scanning direction). At step #235, it is checked that the light intercepting shutter 9 is on (in the light intercepting condition). When the light intercepting shutter 9 is not in the light intercepting condition, it is brought into the light intercepting condition.

At step #240, the scanning direction controlling means controls the scanning by the scanning mirrors 3 and 4 based on the result of the scanning direction detection, and at step #245, scanning determination is performed. The scanning determination subroutine at step #245 is the same as that of the first embodiment (e.g. the first to the third examples shown in FIGS. 6 to 8).

When it is determined that scanning is OK in the scanning determination, the process proceeds from step #250 to step #255. When it is determined that scanning is not OK, the process returns from step #250 to step #235.

At step #255, the light interception controlling means brings the light intercepting shutter 9 into the light transmitting condition (light interception OFF). The picture light is projected onto the viewer's eye under this condition. That is, viewing state is brought about. At step #260, it is determined whether the viewing end switch is operated by the viewer (switch OFF) or not. When the switch is not operated, the process returns to step #240.

When it is determined at step #260 that the switch is OFF, the light intercepting shutter 9 is brought into the light intercepting condition at step #265. Then, at step #270, the scanning direction controlling means stops the scanning by the scanning mirrors 3 and 4, and at step #275, the process waits until the light source 1 is turned off. When the light source 1 is turned off, power is turned off at step #280, so that sleep state is brought about.

In this embodiment, as described previously, the light intercepting shutter 9 brought into the light intercepting condition at step #265 is maintained in the light intercepting condition when power is OFF. When the light intercepting shutter 9 is a mechanical shutter as shown in FIG. 3 or 4, the light intercepting shutter 9 is maintained in the light intercepting condition unless it is brought out of the light intercepting condition. However, for example, when a liquid crystal shutter (LCD shutter) is used, according to the liquid crystal shutter, the light intercepting shutter 9 is brought out of the light intercepting condition the moment when power is turned off. Therefore, in this embodiment, a light intercepting shutter that ensures the light intercepting condition even when power is off is used such that normally black liquid crystal is used when an LCD shutter used.

In this embodiment, since the light intercepting shutter is always in the light intercepting condition when power is off, light generated due to a malfunction caused when power is turned off or a malfunction caused immediately after power is turned on is prevented from being incident on the viewer's eye.

<Third Embodiment>

Figure 10:
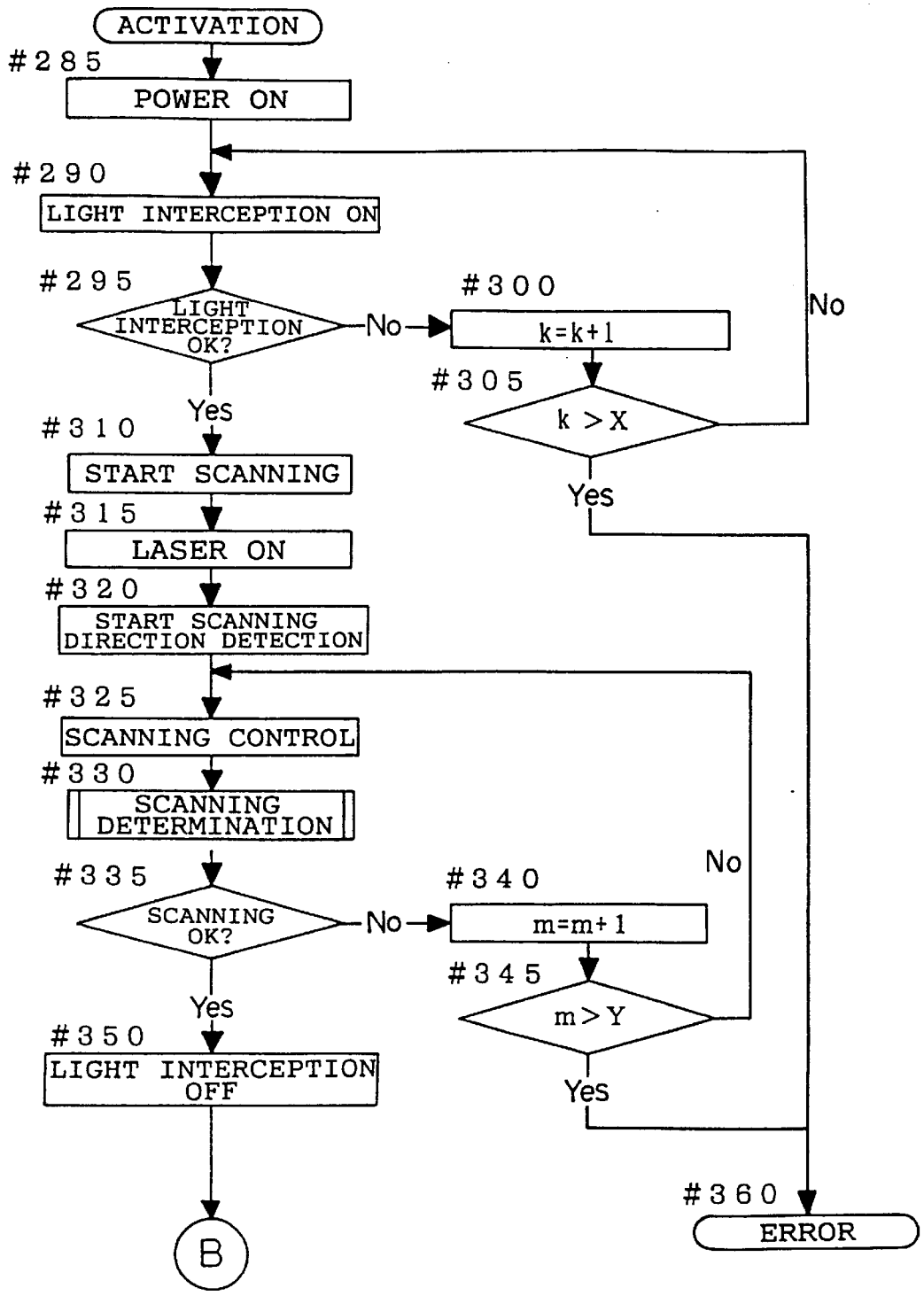
FIG. 10 is a flowchart showing a control method of controlling means of a third embodiment.

FIG. 10 is a flowchart showing a control method of this embodiment. The apparatus structure is similar to that of the first embodiment and therefore will not be described. Based on the viewer's operation, power is turned on at step #285. The values of subsequently-described k and m are initialized the moment when power is turned on. At step #290, it is checked that the light intercepting shutter 9 is in the light intercepting condition. When the light intercepting shutter 9 is not in the light intercepting condition, it is brought into the light intercepting condition. Then, at step #295, it is checked that the light intercepting shutter 9 is in the light intercepting condition.

When it is determined at step #295 that the light intercepting shutter 9 is not in the light intercepting condition, the process proceeds to step #300. At step #300, first, k is set at 1. When a value has already been set as k, the sum of the value and 1 is reset as k. That is, the number of times the process has reached this step is set as k. At step #305, it is determined whether the set value of k exceeds a predetermined value X or not. When k is lower than X, the process returns to step #290 to bring the light intercepting shutter 9 into the light intercepting condition. Then, at step #295, it is checked that the light intercepting shutter 9 is in the light intercepting condition.

When it is determined that the light intercepting shutter 9 is not in the light intercepting condition, steps #300 and #305 are repeated. When it is determined at step #305 that k exceeds the predetermined value X, the process proceeds directly to step #360 to determine that an error occurs. In this case, a warning is given to the viewer or initialization is performed. Thus, this embodiment has a light interception detecting mechanism for performing the check X times or less until the light intercepting shutter 9 is brought into the light intercepting condition. The predetermined value X can be arbitrarily set.

In this embodiment, the light interception detecting function allows light to be surely intercepted before scanning direction detection is started, so that it never occurs that light for scanning direction detection is erroneously incident on the viewer's eye. Thus, the apparatus of this embodiment is safe for the viewer even when high-intensity light is used as the detection light.

When it is checked at step #295 that the light intercepting shutter 9 is in the light intercepting condition, the process proceeds to step #310 to start the scanning by the scanning mirrors 3 and 4. Then, at step #315, the light source 1 is turned on, and at step #320, the PSD 7 starts light detection.

At step #325, the scanning direction controlling means controls the scanning by the scanning mirrors 3 and 4 based on the result of the scanning direction detection. At step #330, scanning determination is performed in a similar manner to that in the second embodiment.

When it is determined that scanning is OK in the scanning determination, the process proceeds from step #335 to step #350. When scanning is not OK, the process proceeds from step #335 to step #340 to set m at 1. When a value has already been set as m, the sum of the value and 1 is re-set as m. That is, the number of times the process has reached this step is set as m.

At step #345, it is determined whether the set value of m exceeds a predetermined value Y or not. When m is lower than Y, the process returns to step #325 to perform scanning control and scanning determination (step #330). Then, at step #335, it is again determined whether scanning is OK or not.

When scanning is not OK, steps #340 and #345 are repeated. When it is determined at step #345 that m exceeds the predetermined value Y, the process proceeds directly to step #360 to determine that an error occurs. In this case, a warning is given to the viewer or initialization is performed. Thus, this embodiment has a scanning stability checking mechanism for performing the check Y times or less until it is determined that scanning is OK. The predetermined value Y can be arbitrarily set. When Y is a high value, error does not readily occur even if scanning is unstable, so that scanning can be waited for to become stable.

In this embodiment, the provision of the scanning stability checking mechanism prevents light from being made incident on the viewer's eye before scanning stability is checked. Thus, the apparatus of this embodiment is safe for the viewer. Moreover, since it is quickly determined that an error occurs when scanning is not OK even after the check is performed a predetermined number of times, the error can be smoothly handled.

When it is determined at step #335 that scanning is OK, the process proceeds to step #350 to bring the light intercepting shutter 9 into the light transmitting condition (light interception OFF). Then, steps #260 to #280 of the second embodiment shown in FIG. 9 (steps within the arrow B) are performed. In this embodiment, when it is determined at step #260 that the switch is not OFF, the process returns to step #325.

<Fourth Embodiment>

Figure 11:
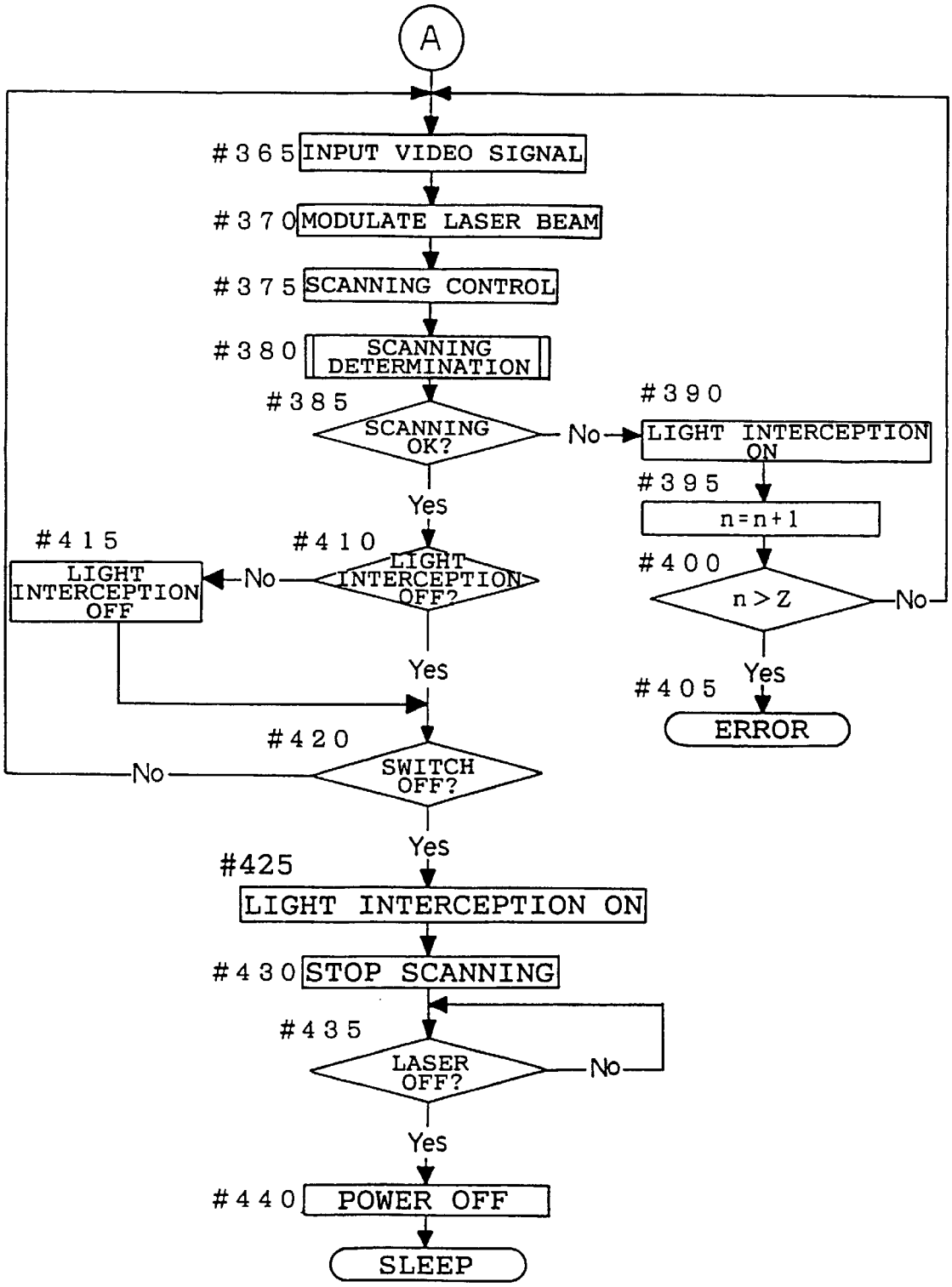
FIG. 11 is a flowchart showing a control method of controlling means of a fourth embodiment.

FIG. 11 is a flowchart showing a control method of this embodiment. The apparatus structure is similar to that of the first embodiment and therefore will not be described. In the part A of the flowchart of FIG. 11, steps #215 to #255 of the second embodiment shown in FIG. 9 (steps within the arrow A) are performed. When power is turned on at step #215, the value of n is initialized. When the light intercepting shutter 9 is brought into the light transmitting condition at step #255, the process proceeds to step #365 to input a video signal. Then, at step #370, the laser beam emitted from the light source 1 is modulated based on the video signal.

At step #375, the scanning direction controlling means controls the scanning by the scanning mirrors 3 and 4 based on the result of the scanning direction detection. At step #380, scanning determination is performed in a similar manner to that at step #245.

When it is determined that scanning is OK in the scanning determination, the process proceeds from step #385 to step #410. When scanning is not OK, the process proceeds from step #385 to step #390 to bring the light intercepting shutter 9 into the light intercepting condition. Then, n is set at 1. When a value has already been set as n, the sum of the value and 1 is re-set as n. That, the number of times the process has reached this step is set as n.

At step #400, it is determined whether the set value of n exceeds a predetermined value Z or not. When n is lower than Z, the process returns to step #365 to perform the control from step #365 to step #380. Then, whether scanning is OK or not is again determined at step #385.

When scanning is not OK, scanning of steps #390 to #400 is repeated. When it is determined at step #400 that n exceeds the predetermined value Z, the process proceeds to step #405 to determine that an error occurs. In this case, a warning is given to the viewer or initialization is performed. Thus, this embodiment has an abnormal scanning checking mechanism for performing the check Z times or less until it is determined that scanning is OX. The predetermined value Z can be arbitrarily set. When Z is a high value, error does not readily occur even when abnormal scanning is performed, so that the process can be waited for to return.

By providing the abnormal scanning checking mechanism like in this embodiment, whether abnormal scanning is performed or not is always checked when pictures are provided, and when abnormal scanning is performed, the light is immediately intercepted. Thus, the apparatus of this embodiment is safe for the viewer.

When it is determined at step #385 that scanning is OK, the process proceeds to step #410 to check whether the light interception is OFF or not. When the light interception is OFF, the process proceeds directly to step #420. When the light interception is ON, after the light interception is made OFF at step #415, the process proceeds to step #420. At step #420, it is determined whether the viewing end switch is operated by the viewer or not. When the switch is not operated, the process returns to step #365.

When it is determined at step #420 that the switch is OFF, the light intercepting shutter 9 is brought into the light intercepting condition at step #425. Then, at step #430, the scanning direction controlling means stops the scanning by the scanning mirrors 3 and 4, and at step #435, the process waits until the light source 1 is turned off. When the light source 1 is turned off, power is turned off at step #440, so that sleep state is brought about.

Obviously, many modifications and variations of the present invention are possible in light of the above teachings. It is therefore to be understood that within the scope of the appended claims, the invention may be practiced other than as specifically described.

What is claimed is:

1. A display apparatus comprising:

a scanning mechanism for scanning light emitted from a light source, the scanned light being directed toward a location for a viewer's pupil;

a detector for detecting whether said scanning by said scanning mechanism is normal or abnormal; and a controller for controlling the light such that the light does not reach the location for the viewer's pupil when said detector detects that the scanning is abnormal.

2. A display apparatus as claimed in claim 1, further comprising an eyepiece optical system for projecting the scanned light to the location for the viewer's pupil.

3. A display apparatus as claimed in claim 2, wherein said light emitted from the light source is modulated based on a video signal.

4. A display apparatus as claimed in claim 3, wherein said scanning mechanism scans the light in two directions that are perpendicular to each other.

5. A display apparatus as claimed in claim 4, wherein said eyepiece optical system provides the viewer with a picture as a virtual image.

6. A display apparatus as claimed in claim 1, wherein said controller includes a light interceptor for intercepting the light and instructs said light interceptor to adopt a light intercepting condition when the scanning is abnormal.

7. A display apparatus as claimed in claim 6, wherein said light interceptor is in a light intercepting condition when power is off.

8. A display apparatus as claimed in claim 6, wherein said light interceptor is a liquid crystal shutter.

9. A display apparatus as claimed in claim 6, wherein said light interceptor is a mechanical shutter.

10. A display apparatus as claimed in claim 6, further comprising a splitter for splitting the scanned light in first and second directions.

11. A display apparatus as claimed in claim 10, wherein said light interceptor is provided between said splitter and the location for the viewer's pupil.

12. A display apparatus as claimed in claim 10, wherein said light split in the first direction is made incident on said detector.

13. A display apparatus as claimed in claim 12, wherein said light split in the second direction is directed toward the location for the viewer's pupil.

14. A display apparatus as claimed in claim 1, wherein said controller stops light emission from said light source when the scanning is abnormal.

15. A display apparatus as claimed in claim 1, further comprising a light interceptor for intercepting the light, wherein the controller instructs the light interceptor to adopt a light intercepting condition when power is turned on, wherein the controller checks whether the light interceptor is in the light intercepting condition, and wherein the controller determines that an error has occurred if the light intercepting condition is not achieved after a predetermined number of checks.

16. A display apparatus as claimed in claim 1, wherein the controller determines that an error has occurred if said scanning is determined to be abnormal a predetermined number of times.

17. A display apparatus as claimed in claim 1, wherein the time required for one complete scan is compared with a permissible time for one complete scan to determine whether the scanning is normal or abnormal.

18. A display apparatus as claimed in claim 1, wherein the time required for scanning between two points on the detector is compared with a permissible time for scanning between said two points on the detector to determine whether scanning is normal or abnormal.

19. A display apparatus as claimed in claim 1, wherein a reference position on the detector is compared with a position of the scanned light on the detector after scanning for a predetermined period of time to determine whether the scanning is normal or abnormal.

20. A display apparatus comprising:

a light source for emitting light modulated based on a video signal;

a scanning mechanism for scanning the emitted light;

a light interceptor for intercepting the emitted light;

a detector for detecting whether scanning by said scanning mechanism is normal or abnormal; and a controller for stopping light emission from said light source when said detector detects that the scanning is abnormal.

21. A display apparatus as claimed in claim 20, wherein said light interceptor intercepts the light until the scanning is brought into a normal condition.

22. A display apparatus as claimed in claim 20, wherein said light interceptor intercepts the light when said detector detects that the scanning is abnormal.

23. A display apparatus as claimed in claim 22, wherein said light interceptor is in a light intercepting condition when power is off.

24. A display apparatus as claimed in claim 20, wherein said light interceptor is a liquid crystal shutter.

25. A display apparatus as claimed in claim 20, wherein said light interceptor is a mechanical shutter.

26. A display apparatus as claimed in claim 20, further comprising an eyepiece optical system for projecting the scanned light.

27. A display apparatus as claimed in claim 26, wherein said scanning mechanism scans the light in two directions that are perpendicular to each other.

28. A display apparatus as claimed in claim 27, wherein said eyepiece optical system provides a viewer with a picture as a virtual image.

* * * * *